US009079238B2

(12) United States Patent
Crabtree

(10) Patent No.: US 9,079,238 B2
(45) Date of Patent: Jul. 14, 2015

(54) COOLANT SYSTEM FOR AN APPARATUS FOR THE PRODUCTION OF CONTAINERS

(75) Inventor: John Andrew Crabtree, Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 838 days.

(21) Appl. No.: 13/139,144

(22) PCT Filed: Dec. 1, 2009

(86) PCT No.: PCT/EP2009/066115
§ 371 (c)(1),
(2), (4) Date: Jun. 10, 2011

(87) PCT Pub. No.: WO2010/066606
PCT Pub. Date: Jun. 17, 2010

(65) Prior Publication Data

US 2011/0239726 A1 Oct. 6, 2011

(30) Foreign Application Priority Data

Dec. 11, 2008 (GB) ..... 0822560.9

(51) Int. Cl.
*B21D 22/28* (2006.01)
*B21D 37/16* (2006.01)

(52) U.S. Cl.
CPC ..... *B21D 37/16* (2013.01); *B21D 22/28* (2013.01)

(58) Field of Classification Search
CPC ..... B21D 37/16; B21D 22/286; B21C 3/14; B21C 9/00
USPC ..... 72/41, 44, 342.1–342.3; 285/95, 106
See application file for complete search history.

(56) References Cited

U.S. PATENT DOCUMENTS

| | | | | |
|---|---|---|---|---|
| 2,914,974 | A * | 12/1959 | Barworth et al. | 72/42 |
| 5,555,761 | A | 9/1996 | Lavy | |
| 7,805,970 | B2 * | 10/2010 | Woulds | 72/349 |
| 2003/0178377 | A1 * | 9/2003 | Larson | 210/799 |

FOREIGN PATENT DOCUMENTS

| | | | | |
|---|---|---|---|---|
| EP | 1448326 | B1 | 10/2007 | |
| GB | 2181082 | A | 4/1987 | |
| JP | 06190486 | A * | 7/1994 | B21J 3/00 |
| WO | WO 93/22079 | A1 | 11/1993 | |
| WO | WO 03/039780 | | 5/2003 | |
| WO | WO 2005/039798 | A1 | 5/2005 | |

* cited by examiner

*Primary Examiner* — Shelley Self
*Assistant Examiner* — Pradeep C Battula
(74) *Attorney, Agent, or Firm* — Baker & Hostetler LLP

(57) ABSTRACT

A closed loop coolant system which ensures the isolation of coolant fluid within an apparatus for producing a metal container by wall ironing. The apparatus includes a die toolpack which reduces the thickness of the container side wall, a ram (5) and a ram guidance assembly (10) which guides the ram along a bore of a tubular assembly. The tubular assembly has a fluid inlet, and the surface of the bore of the tubular assembly has grooves (13) for passage of coolant fluid between the bore and around the outside of the ram (5) and seals for minimizing leakage of oil into the coolant. Coolant is directed back to a tank (20) via a heat exchanger (21) and any oil is skimmer off the coolant by an oil skimmer (24). This oil can then be filtered, cleaned and recycled, or disposed of.

4 Claims, 2 Drawing Sheets

COOLANT SYSTEM FOR AN APPARATUS FOR THE PRODUCTION OF CONTAINERS

CROSS-REFERENCE TO RELATED APPLICATIONS

This application is the National Stage of International Application No. PCT/EP2009/066115 filed Dec. 1, 2009, which claims the benefit of EP application number 0822560.9, filed Dec. 11, 2008, the disclosures of which are incorporated herein by reference in their entirety.

TECHNICAL FIELD

This invention relates to the manufacture of can bodies, for example the production of thin walled metal cans by the so-called "drawing and wall-ironing" ("DWI") process. In a DWI process, a flat circular blank of metal is drawn through one or more drawing dies to form a shallow cup. The cup is then mounted on the free end of a punch which extends from a reciprocating ram, and the cup wall is then "ironed" by passing through one or more ironing dies to lengthen the side wall of the cup to form a can.

The ram effectively cantilevers from its back dead centre position, with a ram guidance system supporting and cooling the ram. Known ram guidance systems reduce maintenance and set-up time. As well as being cooled in the ironing process, the ram and its housing are also cooled externally by the ram guidance assembly. This assembly helps to dissipate heat from the punch mounted on the end of the ram, and maintain the ram at an even temperature. If uneven heat builds up in the ram, this can lead to distortion of the ram. The ram guidance assembly prevents such temperature differences from arising.

BACKGROUND ART

A typical ram guidance assembly which is described in PCT/WO 2005039798 (CROWN PACKAGING TECHNOLOGY INC.) has a seal arrangement to prevent coolant fluid from leaking into the machine at the rear and leaking into the tooling at the front. However, in the ram guidance assembly of PCT/WO 2005039798, the coolant is fed back to the machine collection sump where it is returned to a chiller unit. A check valve is also used to ensure that the assembly stays full of fluid and that there is complete coverage of the ram.

Since oil could have leaked from anywhere in the manufacturing process into the process coolant, this contaminated coolant could deposit oil on cans further down the production line. If such leakage arises due to faulty seals, there is a need to change all seals in the manufacturing process in order to avoid subsequent damage to cans and necessitate scrapping of those cans. Changing of the seals requires machine down time and loss of production time for each machine. This is clearly costly.

DISCLOSURE OF INVENTION

According to the present invention, there is provided an apparatus for the production of a metal container, the apparatus comprising:

a die toolpack adapted to reduce the thickness of the container side wall;

a ram;

a ram guidance assembly which guides the ram along a bore of a tubular assembly, the tubular assembly having a fluid inlet, and the surface of the bore of the tubular assembly having grooves for passage of coolant fluid between the bore and around the outside of the ram; and seals for minimising leakage of oil into the coolant;

in which the apparatus further comprises a closed loop coolant system which ensures the isolation of coolant fluid within that apparatus.

In one embodiment, the apparatus comprises one or more bush housings having a sealed end cap and pipe fitting which directs the cooling fluid ("coolant") back to a coolant tank in the closed loop system. The pipe fitting may be an elbow pipe fitting.

Usually, spiral grooves in the bush housings direct the coolant around the ram to remove heat away from the ram surface. The seals may be provided in a seal pack which aims to stop coolant migrating back into ram lubricating oil and prevent the oil from migrating into the coolant. A film of lubricant is generally required to lubricate the seals, with excess oil being washed from the ram by the coolant.

The problem which the apparatus of the invention seeks to reduce is passage of oil into the coolant, the coolant does not migrate back into the oil. The closed loop coolant system of the apparatus of the present invention allows the performance of the seals to be monitored by monitoring oil in the coolant for that one machine. By using a closed loop system, each machine is isolated and leakage of oil from one machine cannot migrate into another machine. As access to the seals is limited, the typical changeover time may be as much as one hour. With the closed loop system, only the seals on the machine known to have oil leakage need to be changed.

Typically the closed loop system may also include an oil skimmer which separates oil from the coolant. This thus gives an indication of coolant contamination and, if there has been excessive oil leakage, indicates the need for a seal change. The migrated oil can be collected, cleaned and recycled.

BRIEF DESCRIPTION OF FIGURES IN THE DRAWINGS

A preferred embodiment of the invention will now be described, with reference to the drawings, in which.

MODE(S) FOR CARRYING OUT THE INVENTION

Figure 1:
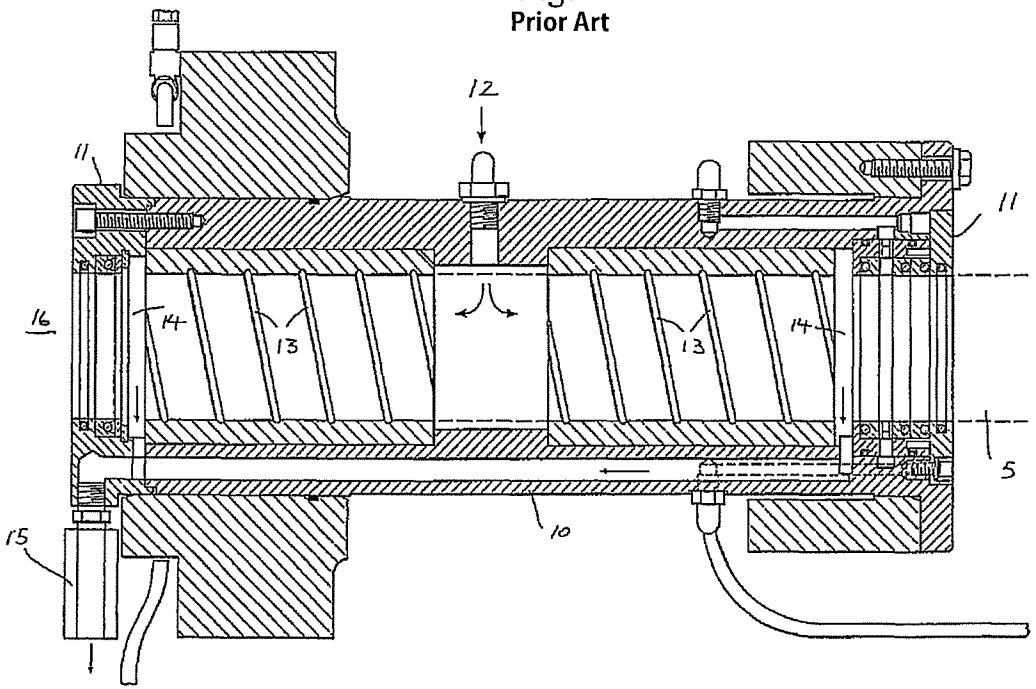
Fig.1 Prior Art
FIG. 1 is a side section of a prior art ram guidance assembly.

FIG. 1 shows the prior art ram guidance assembly which is described in PCT/WO 2005039798. In this document, the ram 5 is cooled externally by the ram guidance assembly 10 which helps to dissipate heat from the punch and maintain the ram 5 at an even temperature. If uneven heat builds up on the ram, this can lead to distortion of the ram. The ram guidance assembly 10 prevents such temperature differences from arising.

The assembly 10 has a seal arrangement 11 at both ends to prevent coolant fluid from leaking into the machine at the rear and leaking into the tooling at the front. The fluid is fed under pressure at the position 12 indicated by the arrow. It then passes along two bushes and around spiral grooves 13 in both directions, lubricating and cooling the ram 5. The coolant exits into cavities 14 between the bushes and the seal packs 11. It then exits the ram guidance assembly via slots and holes in the housing and out through a check valve 15 back to the machine collection sump where it is returned to a chiller unit.

The check valve 15 ensures that the assembly stays full of fluid and that there is complete coverage of the ram.

When the ram 5 is fully back, the end of the punch fitted to the ram is level with the end of the front seal pack at position 16 on the drawing.

Figure 2:
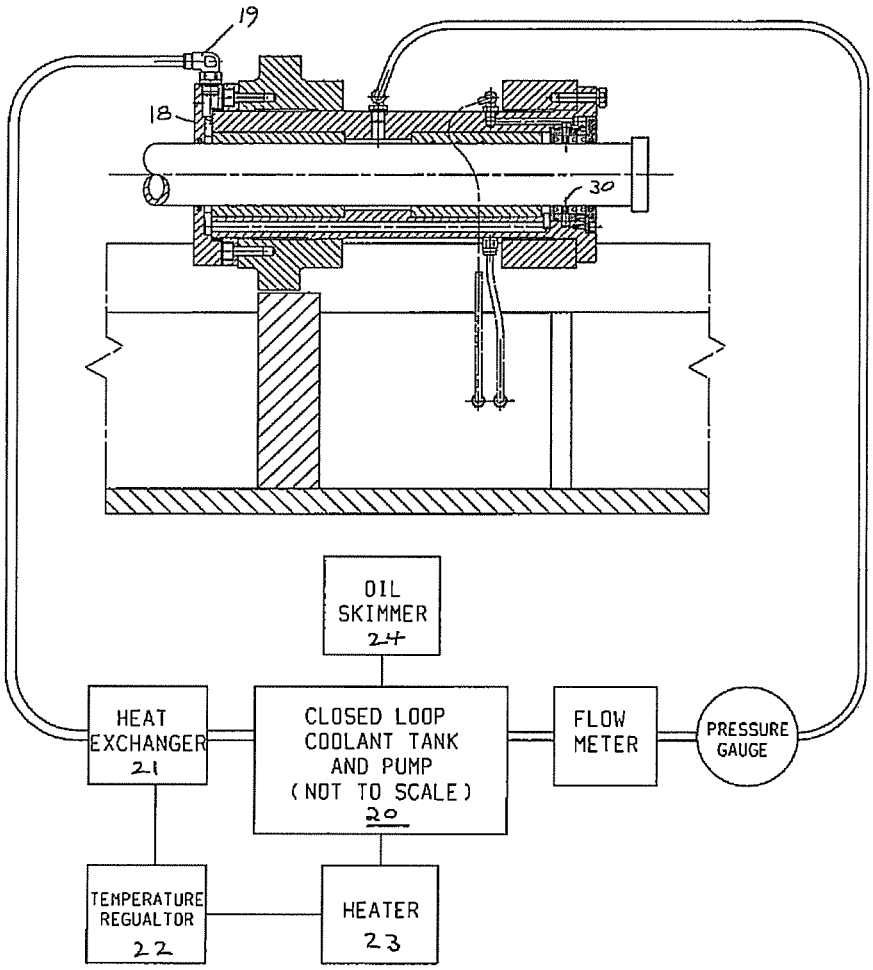
FIG. 2 is a combined flowchart and side section of a ram guidance assembly and closed loop coolant system of the present invention.

Although the prior art ram guidance assembly has a seal arrangement to prevent coolant fluid from leaking into the machine at the rear and leaking into the tooling at the front, the inventor has found that when the seals deteriorate on one machine, oil based lubricant passes into the coolant fluid and back to the collection sump. Contaminated coolant can then be passed around the recirculation system and migrate into other machines. The machine set out in FIG. 2 presents a solution to this problem.

In contrast with the ram guidance assembly of FIG. 1, the front seal assembly has been replaced by a sealed end cap 18 and an elbow fitting 19 directs coolant back to a tank 20 via heat exchanger 21. Temperature regulator and heater 22 ensure that the coolant temperature is adjusted to the correct temperature. Oil may be skimmed off the coolant by oil skimmer 24 and either separated to be filtered, cleaned and recycled, or disposed of. In the worst case, when excessive oil is collected by the oil skimmer, this makes clear that a change of seals 30 in that machine is necessary. However, only the seals of that single machine need to be changed, whereas oil in the sump coolant previously required examination of all of the seals of machines supplied with that coolant further down the production line. This was extremely time consuming and costly.

The invention has been described by way of example only and changes may be made or the invention used on other machines where cross-contamination may occur is also considered possible within the scope of the invention as defined by the claims.

The invention claimed is:

1. An apparatus for the production of a metal container, the apparatus comprising:

a die toolpack adapted to reduce the thickness of a sidewall of the container;

a moveable ram adapted for moving relative to the die toolpack;

a tubular assembly having a surface that defines a bore and a fluid inlet for passage of a coolant fluid into the bore;

a ram guidance assembly adapted for guiding the ram along the bore of the tubular assembly, the surface of the tubular assembly having grooves for passage of the coolant fluid between the surface and around the outside of the ram;

seals for minimising leakage of oil into the coolant fluid; and a closed loop coolant system that includes an oil skimmer that separates the oil from the coolant fluid, the closed loop coolant system being dedicated to the apparatus which ensures the isolation of the coolant fluid within the apparatus for the production of a metal container to thereby provide for an indication of progressive seal failure in the apparatus by monitoring if oil is present in the coolant fluid.

2. An apparatus according to claim 1, wherein the closed loop coolant system comprises a coolant tank and one or more bush housings for directing the coolant fluid back to the coolant tank in the closed loop system.

3. An apparatus according to claim 2, wherein the bush housings define spiral grooves that are adapted for directing the coolant around the ram to remove heat away from the ram surface.

4. An apparatus according to claim 1, wherein the seals are provided in a seal pack to stop the coolant fluid from migrating into the oil and to prevent the oil from migrating into the coolant fluid.

* * * * *